US007349546B2

(12) United States Patent
Ganton

(10) Patent No.: US 7,349,546 B2
(45) Date of Patent: Mar. 25, 2008

(54) SYSTEM AND METHOD FOR IDENTIFYING A HEADSET TYPE IN AN ELECTRICAL DEVICE

(75) Inventor: Robert B. Ganton, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 761 days.

(21) Appl. No.: 10/655,385

(22) Filed: Sep. 4, 2003

(65) Prior Publication Data

US 2005/0053243 A1 Mar. 10, 2005

(51) Int. Cl.
*H04R 29/00* (2006.01)

(52) U.S. Cl. ..... 381/58; 379/430; 381/74; 381/123

(58) Field of Classification Search ..... 381/123, 381/74, 58, 77, 370, 381; 455/569.1, 575.2; 702/183; 324/525; 379/430, 433.13
See application file for complete search history.

(56) References Cited

U.S. PATENT DOCUMENTS 5,161,198 A * 11/1992 Noble ..... 381/81
5,978,689 A * 11/1999 Tuoriniemi et al. ..... 455/569.1
6,069,960 A * 5/2000 Mizukami et al. ..... 381/74
6,397,087 B1 * 5/2002 Kim et al. ..... 455/569.1
6,470,197 B1 * 10/2002 Tuoriniemi et al. ..... 455/575.2
6,594,366 B1 * 7/2003 Adams ..... 381/74
6,711,268 B2 * 3/2004 Colegrave et al. ..... 381/74
2002/0059008 A1 * 5/2002 Wood ..... 700/94

* cited by examiner

*Primary Examiner*—Vivian Chin
*Assistant Examiner*—Lun-See Lao

(57) ABSTRACT

A system and method are presented for identifying, in an electrical device having an audio interface port, a headset type. The system includes a microcontroller logic unit with an output, connected to a test network, to supply a test voltage. The test network also is connected to the audio interface port. The test network can include combinations of resistors, capacitors, and switches. A voltage determination sub-system has an input connected to the interface port line and an output to supply a determination signal responsive to voltage at the audio interface port. The logic unit has an input connected to the determination sub-system output and compares determination signal values with a predetermined threshold value to identify a headset type connected to the audio interface port.

27 Claims, 3 Drawing Sheets

SYSTEM AND METHOD FOR IDENTIFYING A HEADSET TYPE IN AN ELECTRICAL DEVICE

BACKGROUND OF THE INVENTION

1. Field of the Invention

This invention generally relates to audio electrical devices and, more particularly, to a system and method for detecting the type of headset connected to an audio electrical device.

2. Description of the Related Art

The following discussion is directed to wireless communications devices. However, it should be understood that the discussion applies to other types of electronic devices as well. Wireless communications devices are being developed to perform functions beyond those associated with traditional voice communication. Among those functions is the ability to provide audio signals to a headset plugged into the device. To perform audio functions properly, to manage energy consumption in the wireless device, and to prevent damage to circuitry caused by the application of incompatible signals, the device must be able to distinguish a stereo headset from a different type of accessory, for example, a mono headset, plugged into a device interface port. For example, supplying a stereo signal to a mono headset wastes energy in the device and supplying a mono signal to a stereo headset fails to utilize the features of the headset. At the same time, wireless device users demand smaller and more inexpensive devices with added capabilities, creating in turn, a need to reduce the number and cost of components in the device. An undesirably large number of components are typically used in a wireless device to identify the type of accessory plugged into the device. Unfortunately, increasing the number and complexity of components in a device can limit the size to which the wireless device can be reduced and can add to the cost of producing the wireless device.

It would be advantageous if a wireless communications device could identify the type of headset plugged into the device using a minimal number of relatively simple components.

SUMMARY OF THE INVENTION

The present invention addresses identification of a headset plugged into a device audio interface port. The invention recognizes that the device must identify the headset type to provide proper audio signals to the headset. The invention addresses this problem by using a small number of relatively simple components in the device to identify the voltage level associated with a headset type.

Accordingly, a system is provided for identifying a headset type in an electrical device having an audio interface port. The system includes a microcontroller logic unit with an output connected to a test network, the output to supply a test voltage. The test network also is connected to the audio interface port. The test network can include combinations of resistors, capacitors, and switches. A voltage determination sub-system, in one case, an analog-to-digital converter (ADC), has an input connected to the audio interface port and an output to supply a determination signal proportional to a voltage at the audio interface port. The logic unit has an input connected to the voltage determination sub-system output and compares determination signal values with a predetermined threshold value to identify a headset type connected to the audio interface port. In some cases, a digital-to-analog converter (DAC) supplies stereo signals in response to the logic unit identifying a stereo headset.

Additional details of the above-described system and a method for identifying, in an electrical device having an audio interface port, a headset type are provided below.

DETAILED DESCRIPTION OF THE PREFERRED EMBODIMENTS

Figure 1:
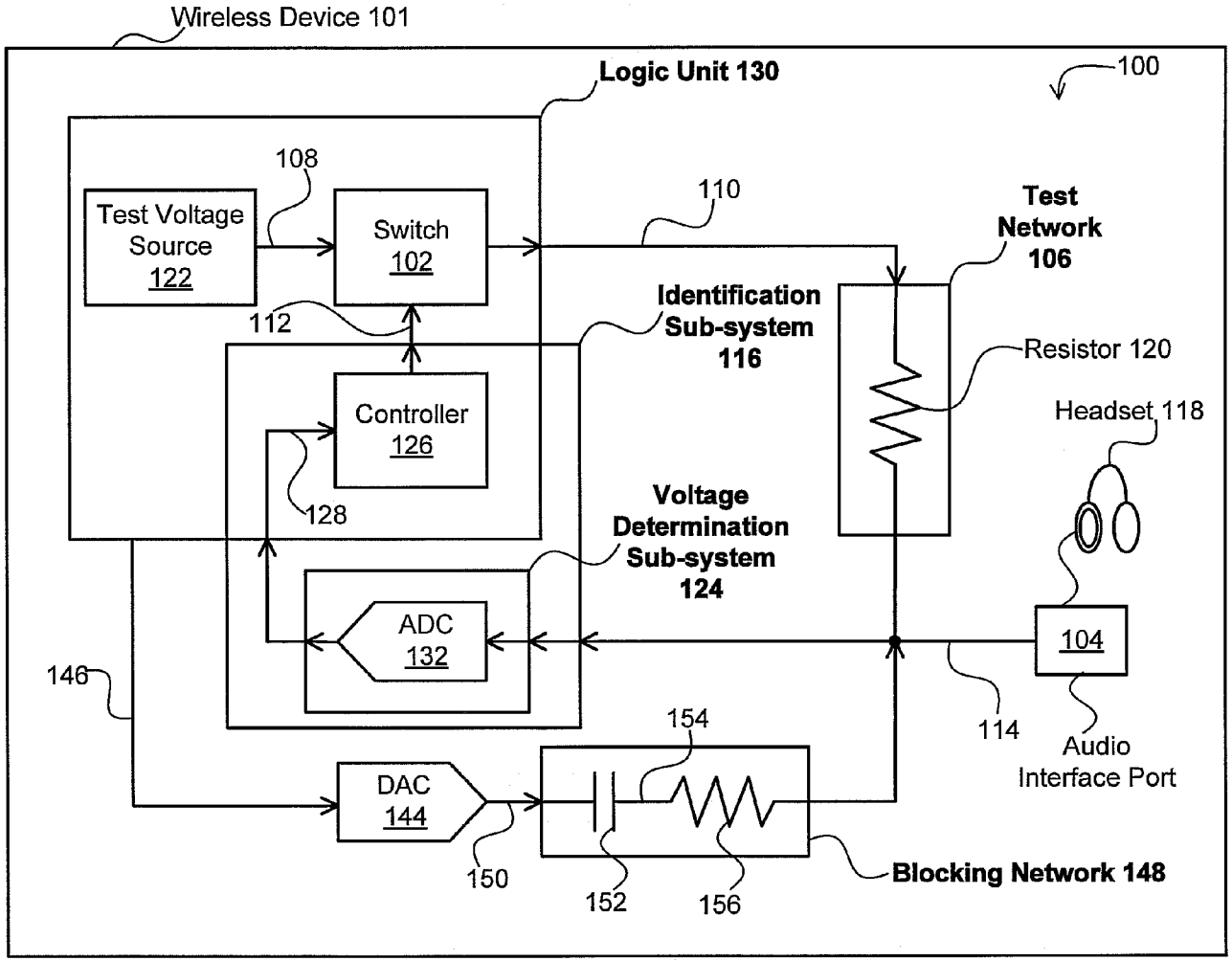
FIG. 1 is a schematic block diagram of a system for identifying a headset type in an electrical device having an audio interface port.

FIG. 1 is a schematic block diagram of a system 100 for identifying a headset type in an electrical device having an audio interface port. The system 100 in wireless communications device 101 includes a test switch 102, an audio interface 104, and a test network 106. The switch 102 has an input to accept a test voltage on line 108, an output connected to a network 106 port on line 110, and a control input to accept a switch control signal on line 112. The switch 102 operates in response to accepting the switch control signal. The network 106 has a port connected to an audio interface 104 port on line 114. It should be understood that the wireless communications device 101 is used as an example only and that the system 100 is not limited to wireless communications devices.

The system 100 also includes an identification sub-system 116. The identification sub-system 116 has an input connected to the audio interface 104 port on line 114 and an output on line 112 to supply the switch control signal. In general, the identification sub-system 116 determines the voltage on line 114 and distinguishes among accessories or sets of accessories (not shown) connected to line 114 in response to comparing the voltage level on line 114 with a first predetermined threshold value.

A network 106 resistance, say $R_2$, further explained below, and a resistance, say $R_1$, for an accessory connected to the audio interface 104 form a voltage divider for the test voltage. For two resistances, $R_1$ and $R_2$, in series, a voltage divider is formed by applying a voltage $V_1$ to $R_1$. For the voltage divider, a voltage at the node between $R_1$ and $R_2$ is equal to $[V_1\ R_2]/[R_1+R_2]$. In system 100, a voltage on line 114, $V_{114}$=[test voltage][accessory resistance]/[network resistance+accessory resistance]. Thus, the first predetermined threshold value described above can be selected proportional to the $V_{114}$ associated with a particular accessory or accessories. For example, if a first accessory results in a $V_{114}$ of 0.5V, and a second accessory above results in a $V_{114}$ of 0.1V, the first threshold value in the identification sub-system 116 can be selected proportional to a value between 0.5V and 0.1V, say 0.3V, to distinguish between the first and second accessories.

In FIG. 1, a headset 118 is shown connected to the interface 104. In general, the identification sub-system 116 distinguishes between a stereo headset 118 and a mono headset 118 by comparing the voltage level on line 114 with a second predetermined threshold value. In one aspect, the identification sub-system 116 identifies a stereo headset 118 on the line 114 in response to determining a voltage level on line 114 above the second predetermined threshold value and a mono headset on the line 114 in response to determining a voltage level on line 114 below the second predetermined threshold value. To illustrate, in some aspects, the test network 106 is a resistor 120 with an end connected to line 110 and an end connected to line 114. Other combinations of components in the network 106 are described below. Assume values of 100 ohms for resistor 120 and 2V for the test voltage. A typical resistance for a stereo headset 118 speaker (not shown) is 16 ohms. Thus, for a typical stereo headset 118, $V_{114}$=[2V][16 ohms]/116 ohms=0.28V. For a mono headset 118, the line is grounded and the headset resistance is essentially zero ohms. Therefore, for a mono headset 118, $V_{114}$ is very nearly 0V. Thus, the second predetermined threshold in the identification sub-system 116 can be selected below 0.28V or, most probably, 0.14V in this numerical example, to distinguish between a stereo and a mono headset 118. It should be understood that the system 100 is not limited to the test voltage values and the resistance values used above and that other voltage and resistance values are applicable to the system 100.

It should be understood that the relationship between the second threshold value and voltages on line 114 can be inverted (not shown). In that case, the identification sub-system 116 identifies a stereo headset 118 on the line 114 in response to determining a voltage level on line 114 below the second predetermined threshold value and a mono headset on the line 114 in response to determining a voltage level on line 114 above the second predetermined threshold value.

In some aspects, the system 100 includes a test voltage source 122 and the identification sub-system 116 includes a voltage determination sub-system 124 and a controller 126. The test voltage source 122 has an output connected to the switch 102 input on line 108. The voltage determination sub-system 124 has an input connected to line 114 and an output on line 128 to supply a determination signal responsive to the voltage at the audio interface port 104. The controller 126 has an input on line 128 to accept the determination signal and an output on line 112 to supply the switch control signal. The controller 126 distinguishes between a stereo headset 118 and a mono headset 118 by comparing the determination signal received on line 128 to a third predetermined threshold value. In one aspect, the controller 126 identifies a stereo headset 118 connected to the audio interface port 104 in response to accepting a determination signal with a value above the third predetermined threshold value and a mono headset 118 in response to accepting a determination signal with a value below the third threshold value.

It should be understood that the relationship between the third threshold value and the determination signals on line 128 can be inverted (not shown). Then, the controller 126 identifies a stereo headset 118 on the line 114 in response to accepting a determination signal with a value below the third predetermined threshold value and a mono headset 118 in response to accepting a determination signal with a value above the third threshold value.

In some aspects, the system 100 includes a microcontroller logic unit 130. The microcontroller logic unit 130 includes the switch 102, the test voltage source 122, and the controller 126 and has an input connected to the voltage determination sub-system 124 output on line 128 and a general purpose input/output pin connected to the test network 106 port on line 110. The controller 126 input on line 128 is connected to the logic unit 130 input and the switch 102 output is connected to the logic unit general purpose input/output pin on line 110.

In some aspects, the voltage determination sub-system 124 is an analog-to-digital converter (ADC) 132 with an input connected to line 114 and an output connected to line 128. Typically, the ADC 132 is a "house keeping" ADC (HKADC). HKADCs generally operate at lower resolutions and speeds, which are adequate for the measurements required for the voltage determination sub-system 124 functions.

Figure 2A:
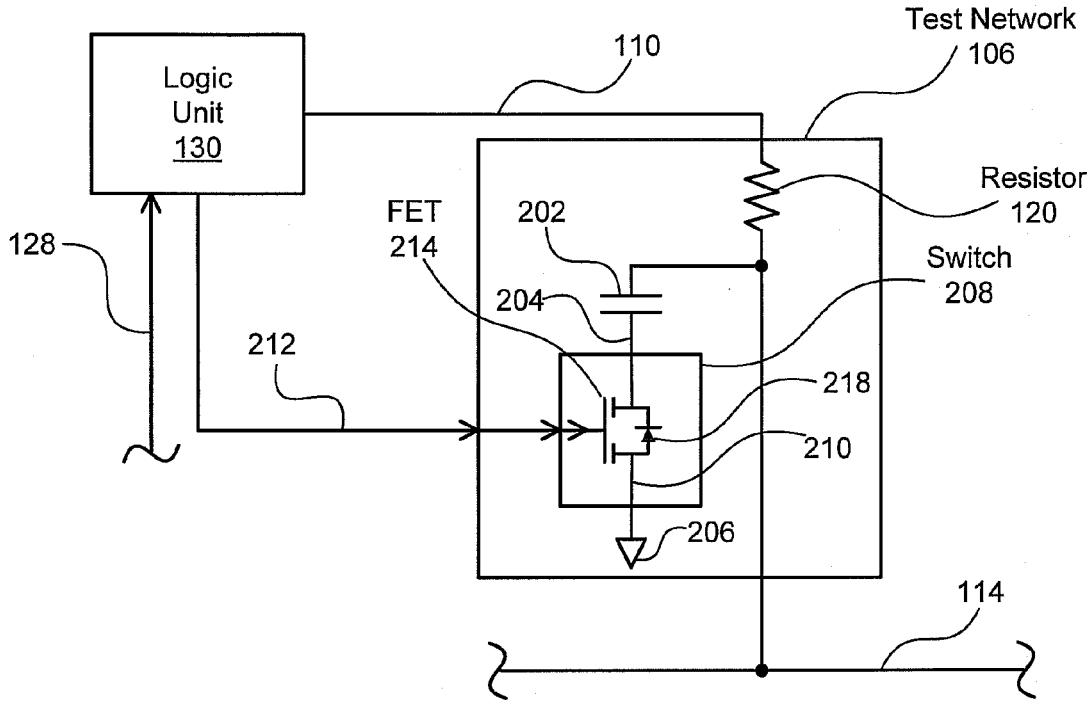
FIGS. 2A and 2B are a schematic block diagrams showing in further detail the system shown in FIG. 1.

FIG. 2A is a schematic block diagram showing in further detail the system 100 shown in FIG. 1. The performance of the system 100 can be improved by reducing the rate of change for a voltage on line 114 ($V_{114}$) resulting from the application of the test voltage to line 110. To accomplish this, additional components can be added to the test network 106. In one aspect, a capacitor 202 is added. The capacitor 202 has one end connected on line 204 to ground 206 and has a second end connected to the resistor 120 on line 114. The resulting RC network reduces the rate of change of $V_{114}$. However, when an audio signal is applied to line 114, the RC network causes a small "shoulder", at the characteristic frequency for the RC network, in the frequency response of the audio signal magnitude. The generation of audio signals is further described below. Although the attenuation noted above is relatively insignificant, steps can be taken to eliminate the attenuation, for example, by controlling the effects of capacitor 202. Therefore, in some aspects, a switch 208 is added between the capacitor 202 and the ground 206. The switch 208 has an input connected to the capacitor 202 on line 204, an output connected to the ground 206 on line 210, and a control input to receive control signals on line 212. Opening the switch 208 isolates the capacitor 202 from the ground 206 and eliminates the function of capacitor 202 from the network 106. Further detail regarding the opening of switch 208 and the generation of audio signals is provided below. The switch 208 closes in response to accepting a test control signal on line 212. In this mode, the capacitor 202 conducts to ground 206 and the RC network noted above is active. The logic unit 130 includes an output on line 212 to supply the test control signal in response to supplying a test voltage on line 110. The switch 208 remains closed while the test voltage is applied to line 110 and the logic unit 130 is comparing the determination signal on the line 128 to the threshold value.

In some aspects, the switch 208 is a transistor with a terminal connected to capacitor 202 on line 204, a terminal connected to ground 206 on line 210, and a control terminal connected to the logic unit 130 output on line 212. The transistor is enabled in response to accepting the test control signal, creating a signal path between lines 204 and 210. In some aspects, the transistor is a field effect transistor (FET) or a bi-polar junction transistor (BJT). In FIG. 1, an FET 214 is shown. The diode 218 in the FET 214 is oriented so that the FET 214 conducts to ground only when the FET 214 is enabled.

Figure 2B:
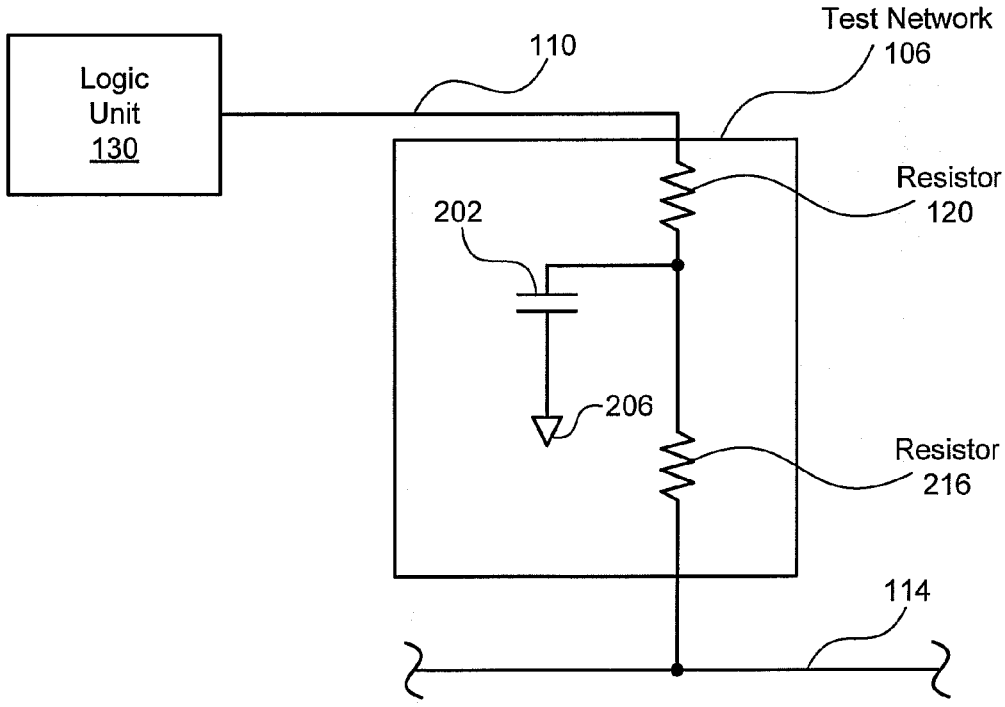

FIG. 2B is a schematic block diagram showing in further detail the system 100 shown in FIG. 1. As noted above, attenuation, associated with the RC network of resistor 120 and capacitor 202, of an audio signal applied to line 114 can be eliminated by controlling the effects of capacitor 202. In some aspects, this is accomplished by adding a resistor 216 and the capacitor 202 to the network 106 as shown in FIG. 2B. When the test voltage is applied to line 110, the resistors 120 and 216 and the headset (reference designator 118 in FIG. 1) resistance form a voltage divider. In this case, $V_{114}$=[test voltage][headset resistance]/[resistor 122+resistor 216+headset resistance]. The resistors 120 and 216 and the capacitor 202 form an RC network effecting the reduction of the rate of change for the voltage on line 114, as described for FIG. 1. When an audio signal is applied to line 114, the resistor 216 can essentially block the signal from conducting through the capacitor 202 to ground 206 if the value of resistor 216 is sufficiently large compared to a resistance for headset 118. In this manner, the effects of capacitor 202 are eliminated while the audio signal is applied to line 114. In some aspects, resistors 120 and 216 are selected at 910 ohms and the capacitor 202 is selected at 0.1 microfarads. It should be understood that the system 100 is not limited to these values.

Returning to FIG. 1, in some aspects, the system 100 includes a digital-to-analog converter (DAC) 144 with an input on line 146 to accept a stereo control signal and an output on line 114, the output to supply stereo signals in response to accepting the stereo control signal. The logic unit 130 includes an output on line 146 to supply the stereo control signal in response to the logic unit 130 identifying a stereo headset 118. Returning to FIG. 2A, the logic unit 130 output on line 212 supplies a termination signal in response to the logic unit 130 supplying the stereo control signal on line 146. In response to a termination signal on line 212, the switch 208 opens, eliminating the effects of the capacitor 202. Returning to FIG. 2B, in some aspects, the logic unit 130 output on line 110 enters a "tri-state" in response to the logic unit supplying the stereo control signal on line 146.

In some aspects, the system 100 includes a blocking network 148 with a port connected to the DAC 144 output on line 150 and a port connected to line 114. In some aspects, the blocking network 148 includes a capacitor 152 with an end connected to the DAC 144 output on line 150 and an end on line 154 and a resistor 156 with an end connected to the capacitor 152 on line 154 and an end connected to line 114. The blocking network 148 isolates the DAC 144 output from DC and low frequency signals, protecting the DAC 144 from damage such signals could potentially cause.

Figure 3:
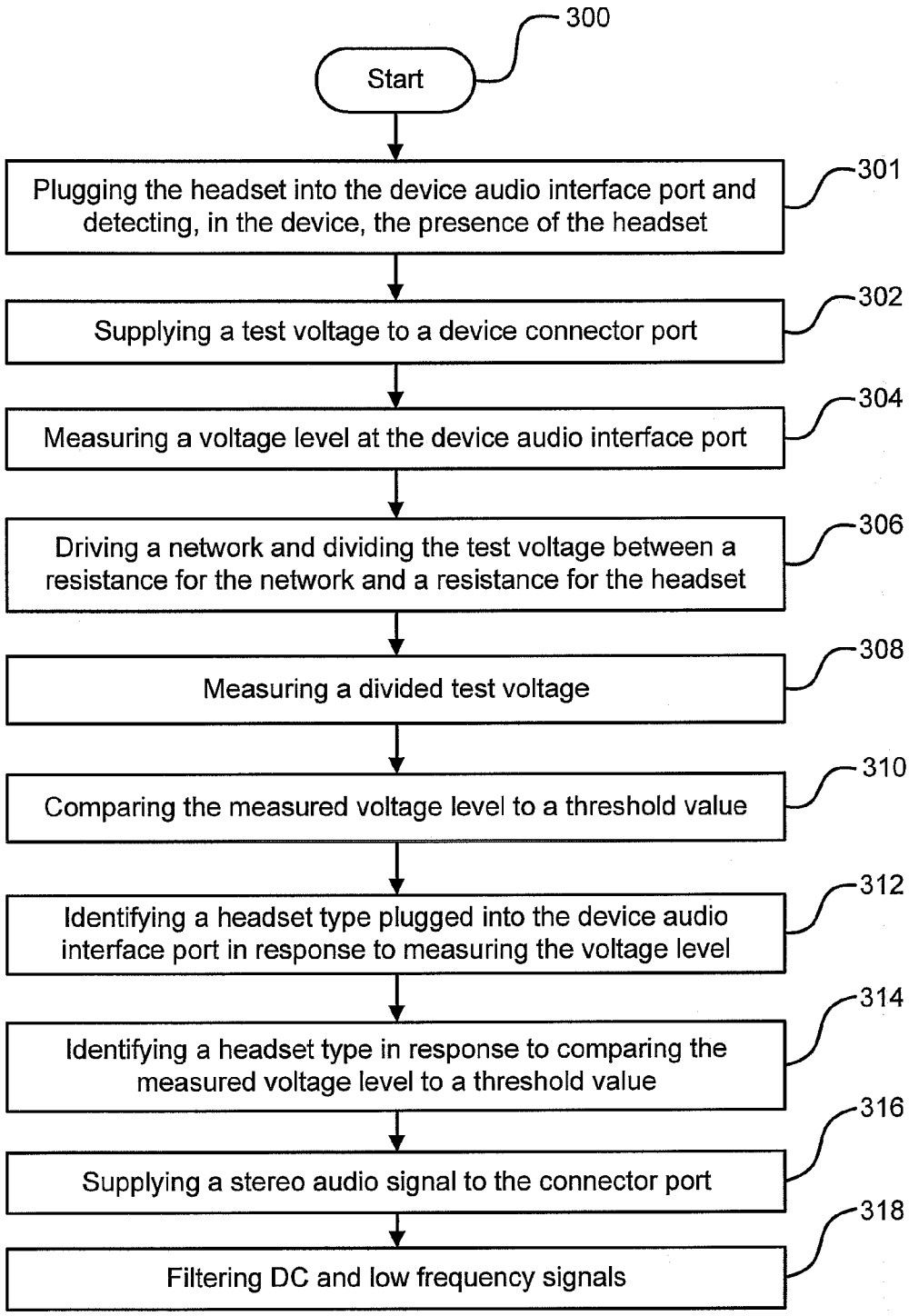
FIG. 3 is a flow chart illustrating a method for identifying a headset type in an electrical device having an audio interface port.

FIG. 3 is a flow chart illustrating a method for identifying a headset type in an electrical device having an audio interface port. Although the method in FIG. 3 is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts with Step 300. Step 302 supplies a test voltage to a device connector port. Step 304 measures a voltage level at the device audio interface port. Step 306 drives a network and divides the test voltage between a resistance for the network and a resistance for the headset. Step 308 measures a divided test voltage. Step 310 compares the measured voltage level to a threshold value. Step 312 identifies a headset type plugged into the device audio interface port in response to measuring the voltage level. Step 314 identifies a headset type in response to comparing the measured voltage level to a threshold value.

In some aspects, a Step 301 plugs the headset into the device audio interface port and detects, in the device, the presence of the headset. In some aspects, a Step 316 supplies a stereo audio signal to the connector port. In some aspects, a Step 318 filters DC and low frequency signals. In some aspects, supplying a stereo audio signal to the connector port in Step 316 includes open circuiting the network.

In some aspects, driving a network with the test voltage and dividing the test voltage between a resistance for the network and a resistance for the headset in Step 306 includes using the network to reduce a rate of change for the voltage at the device audio interface port. In some aspects, measuring a divided test voltage in Step 308 includes accepting an analog voltage, converting the analog voltage to a digital signal, and interpreting the digital signal.

In some aspects, identifying a headset type in Step 314 includes identifying a stereo headset for a measured voltage level greater than the threshold value and identifying a mono headset for a measured voltage level less than the threshold value. In some aspects, identifying a headset type in Step 314 includes identifying a stereo headset for a measured voltage level less than the threshold value and identifying a mono headset for a measured voltage level greater than the threshold value.

A system and a method are provided for identifying a headset type in an electrical device having an audio interface port. Examples of the present invention have been enabled with a wireless communications device, audio signals, and a headset. However, it should be understood that the present invention is not limited to wireless communications devices, audio signals, or headsets. The present invention system and method are applicable to any device receiving electrical signals from an external accessory and can be used to identify external accessories other than headsets. For example, the invention could be used to identify Universal Serial Bus (USB) accessories interfacing with a device. The present invention system and method also are applicable to any device making decisions based on the level of electrical signals from an external accessory. Other variations and embodiments of the present invention will occur to those skilled in the art.

Although the invention has been described with reference to particular embodiments, the description is only an example of the invention's application and should not be taken as a limitation. Consequently, various adaptations and combinations of features of the embodiments disclosed are within the scope of the invention as encompassed by the following claims.

I claim:

1. In an electrical device having an audio interface port, a method for identifying a headset plugged into the device audio interface port, the method comprising:

supplying a test voltage to the device audio interface port;

measuring a voltage level at the device audio interface port that includes comparing the measured voltage level to a threshold value;

identifying a headset type plugged into the device audio interface port in response to measuring the voltage level and comparing the measured voltage level to the threshold value;

identifying a stereo headset with a measured voltage level that exceeds the threshold value; and identifying a mono headset with the measured voltage level indicating that the mono headset is configured to be grounded.

2. The method of claim 1 wherein identifying a headset type in response to comparing the measured voltage level to a threshold value further comprising:

identifying the stereo headset for a measured voltage level greater than the threshold value; and identifying the mono headset for a measured voltage level less than the threshold value.

3. The method of claim 1 wherein identifying a headset type in response to comparing the measured voltage level to a threshold value further comprising:

Identifying the stereo headset for a measured voltage level less than the threshold value; and Identifying the mono headset for a measured voltage level greater than the threshold value.

4. The method of claim 1 wherein measuring a voltage level at the device audio interface port further comprising:

driving a network with the test voltage and dividing the test voltage between a resistance for the network and a resistance for the headset; and measuring a divided test voltage at the audio interface port.

5. The method of claim 4 wherein measuring the divided test voltage at the audio interface port further comprising:

accepting an analog voltage;

converting the analog voltage to a digital signal; and interpreting the digital signal.

6. The method of claim 4 wherein the supplying the audio signal to the device audio interface port comprises supplying a stereo audio signal in response to identifying a stereo headset.

7. The method of claim 4 wherein driving a network with the test voltage and dividing the test voltage between a resistance for the network and a resistance for the headset further comprises using the network to reduce a rate of change for the voltage at the device audio interface port.

8. The method of claim 1 further comprising:

plugging the headset into the device audio interface port; and, detecting, in the device, the presence of the headset.

9. In an electrical device having an audio interface port, a system for identifying a headset plugged into the device audio interface port, the system comprising:

an audio interface port to accept variable impedance headphone jacks;

a first switch with an input connected to receive a test voltage, a control input to accept a switch control signal, and an output to supply the test voltage in response to the switch control signal, a test network with a first port connected to the first switch output and a second port connected to the audio interface port, the test network to condition current to the audio interface port; and, an identification sub-system with an input connected to the audio interface port and an output to supply the switch control signal, the identification sub-system determining voltage levels at the audio interface port and comparing voltage levels with a first predetermined threshold value to identify a headset type connected to the audio interface port, in which a stereo headset is identified with a measured voltage level that exceeds the threshold level and a mono headset identified by the measured voltage level indicating the mono headset is configured to be grounded.

10. The system of claim 9 wherein the identification sub-system identifies the stereo headset in response to determining a voltage level above the first threshold value and the mono headset in response to determining a voltage level below the first threshold value.

11. The system of claim 9 wherein the identification sub-system identifies the stereo headset in response to determining a voltage level below the first threshold value and the mono headset in response to determining a voltage level above the first threshold value.

12. The system of claim 9 further comprising: a test voltage source with an output connected to the first switch input; and, wherein the identification sub-system includes: a voltage determination sub-system with an input connected to the audio interface port and an output to supply a determination signal responsive to the voltage at the audio interface port; and, a controller having an input connected to the voltage determination sub-system output and an output to supply the switch control signal, the controller comparing determination signals with a second predetermined threshold value to identify a headset type connected to the audio interface port.

13. The system of claim 12 wherein the controller identifies a stereo headset connected to the audio interface port in response to accepting a determination signal with a value above the second predetermined threshold value and a mono headset in response to accepting a determination signal with a value below the second threshold value.

14. The system of claim 12 wherein the controller identifies a stereo headset connected to the audio interface port in response to accepting a determination signal with a value below the second predetermined threshold value and a mono headset in response to accepting a determination signal with a value above the second threshold value.

15. The system of claim 12 further comprising a microcontroller logic unit with an input and a first output connected to the test network first port; and, wherein the controller, the test voltage source, and the first switch are included in the microcontroller logic unit, the controller input and the voltage determination sub-system output are connected to the logic unit input, and the first switch output is connected to the logic unit first output.

16. The system of claim 15 wherein the voltage determination sub-system is an analog-to-digital converter (ADC) with an input connected to the audio interface port and an output connected to the logic unit input.

17. The system of claim 15 wherein the test network includes a first resistor with a first end connected to the logic unit first output and a second end connected to the audio interface port.

18. The system of claim 17 wherein the test network further includes a first capacitor with a first end connected to the first resistor second end and a second end connected to ground.

19. The system of claim 18 wherein the test network further includes a second switch with a first port connected to the first capacitor second end, a second port connected to ground, and a control input to accept first control signals, the second switch to close in response to accepting a first test control signal; and, wherein the logic unit includes a second output to supply first control signals, the output to supply the first test control signal in response to the logic unit supplying a test voltage at the first output.

20. The system of claim 19 wherein the second switch is a transistor with a first terminal connected to the first capacitor second end, a second terminal connected to ground, and a control terminal connected to the logic unit second output, the transistor being enabled in response to accepting the first test control signal.

21. The system of claim 20 wherein the transistor is selected from the group including field effect transistors (FETs) and bi-polar junction transistors (BJTs).

22. The system of claim 18 wherein the test network further includes a second resistor with a first end connected to the first resistor second end and a second end connected to the audio interface port.

23. The system of claim 17 further comprising:

a digital-to-analog converter (DAC) with an input to accept a stereo control signal and an output connected to the audio interface port, the output to supply stereo signals in response to accepting the stereo control signal; and, wherein the logic unit includes a third output connected to the DAC input, the third output to supply the stereo control signal in response to the logic unit identifying a stereo headset on the audio interface port.

24. The system of claim 23 wherein the test network further includes:

a second capacitor with a first end connected to the first resistor second end and a second end; and, a third switch with a first port connected to the second capacitor second end, a second port connected to ground, and a control input to accept second control signals, the third switch closing in response to accepting a second test control signal and opening in response to accepting a termination second control signal; and, wherein the logic unit includes a fourth output connected to the third switch control input, the fourth output to supply a second test control signal in response to the logic unit supplying a test voltage at the first output and the termination second control signal in response to the logic unit supplying the stereo control signal.

25. The system of claim 23 further comprising:

a blocking network with a first port connected to the DAC output and a second port connected to the audio interface port.

26. The system of claim 17 further comprising:

the audio interface port with at least four lines; and, the headset plugged into the audio interface port.

27. In an electrical device having an audio interface port, a system for identifying a headset plugged into the device audio interface port, the system comprising:

the audio interface port;

a headset plugged into the audio interface port;

an analog-to-digital converter (ADC) with an input connected to the audio interface port and an output to supply a determination signal responsive to a voltage level on the audio interface port;

a microcontroller logic unit with: a first output to supply a test voltage signal, an input to accept the determination signal, the logic unit to compare determination signal values with a predetermined threshold value to identify a headset type connected to the audio interface port, wherein a stereo headset is identified with a measured voltage level that exceeds the threshold level and a mono headset identified by the measured voltage level indicating the mono headset is configured to be grounded; and a second output to supply a stereo control signal in response to identifying a stereo headset;

a test network including: a first resistor with a first end connected to the logic unit first output and a second end; a capacitor with a first end connected to the first resistor second end and a second end connected to ground; and, a second resistor with a first end connected to the first resistor second end and a second end connected to the audio interface port;

a digital-to-analog converter (DAC) with an input connected to the logic unit second output and an output to supply stereo audio signals in response to the DAC accepting a stereo control signal; and, a blocking network including: a capacitor with a first end connected to the DAC output and a second end; and, a resistor with a first end connected to the capacitor second end and a second end connected to the audio interface port.

* * * * *